United States Patent [19]

Vdoviak

[11] 3,931,707

[45] Jan. 13, 1976

[54] AUGMENTOR FLAMEHOLDING APPARATUS

[75] Inventor: John William Vdoviak, Marblehead, Mass.

[73] Assignee: General Electric Company, Lynn, Mass.

[22] Filed: Jan. 8, 1975

[21] Appl. No.: 539,315

[52] U.S. Cl. ..... 60/39.72 R; 60/39.82 P; 60/261

[51] Int. Cl.[2] ..... F02C 3/00; F02K 3/10

[58] Field of Search ..... 60/39.72 R, 39.82 P, 261, 60/39.74 R

[56] References Cited

UNITED STATES PATENTS

| | | | |
|---|---|---|---|
| 2,546,432 | 3/1951 | Darling | 60/39.72 R |
| 2,964,907 | 12/1960 | Toone | 60/39.72 R |
| 3,540,216 | 11/1970 | Quillevere et al. | 60/39.72 R |
| 3,765,178 | 10/1973 | Hufnagel et al. | 60/39.72 R |
| 3,788,065 | 1/1974 | Markowski | 60/39.74 R |
| 3,800,527 | 4/1974 | Marshall et al. | 60/39.72 R |

FOREIGN PATENTS OR APPLICATIONS

| | | | |
|---|---|---|---|
| 674,641 | 6/1952 | United Kingdom | 60/39.82 P |

*Primary Examiner*—Carlton R. Croyle
*Assistant Examiner*—Robert E. Garrett
*Attorney, Agent, or Firm*—James W. Johnson, Jr.; Derek P. Lawrence

[57] ABSTRACT

A flameholder for the afterburner of an aircraft gas turbine engine is provided which comprises a pair of concentric rings forming an annular flow passage therebetween which has a continuous annular inlet for receiving the gas flow from the turbine exhaust. A plurality of discrete pilot fuel jets eject pilot fuel into the passage. A plurality of flow vanes are positioned within and around the circumference of the annular flow passage in order to impart a circumferential swirl to the fuel-air mixture and thereby improve the mixing and vaporizing thereof. An igniter of the spark type is positioned downstream of the swirl vanes. The outer annular wall of the flow passage extends downstream of and diverges conically outward from the inner wall of the flow passage. An annular V-shaped gutter is secured to the downstream end of the inner wall of the annular flow passage in order to provide a stable flameholding surface. The pre-mixed, vaporized fuel recirculates into the V-gutter to provide combustion stability. A plurality of radially extending V-shaped vanes may also be secured to the downstream end of the inner annular wall of the annular flow passage in order to further spread the flame.

11 Claims, 5 Drawing Figures

AUGMENTOR FLAMEHOLDING APPARATUS

BACKGROUND OF THE INVENTION

This invention relates to an afterburner flameholder and, more particularly, to an afterburner flameholder for inclusion within the high velocity gas stream of an aircraft gas turbine engine as part of an afterburning system to provide additional thrust augmentation.

It is well known in the aircraft gas turbine art to provide thrust augmentation by burning additional fuel in an afterburner located downstream of the engine turbine. The afterburner generally includes means for dispersing a main flow of fuel together with a flameholder to which the flame may attach. The flameholder reduces locally the velocity of the gas stream and establishes a recirculation zone within the afterburner in order to sustain the flame which would otherwise blow out. The flameholder further provides an ignition and low temperature rise zone which, in conjunction with additionally injected fuel in parallel and sequentially to a pilot fuel flow, provides staging to accomplish broad temperature modulation of the afterburner. One well known type of flameholder comprises two concentric flame rings arranged to diverge from each other in a downstream direction. Fuel may be introduced either uniformly upstream of the flameholder or in locally concentrated manner so that fuel droplets impinge upon the outside diverging surfaces of the flameholder and the afterburning flame attaches to the trailing edges of the flame rings.

In order to provide for positive and uniform lightoff of the afterburner during all modes of flight operation, pilot fuel may be introduced and sparked to ignite by means of a point source igniter. The pilot flame, in turn, operates to ignite the main fuel droplets. It is well known to introduce the pilot fuel to the afterburner by means of discrete jets situated around the flameholder. The pilot fuel jets are generally located intermediate the flame rings such that each pilot jet receives gas flow from the turbine exhaust through an inlet to the flameholder..

One afterburner flameholder of this type is described in U.S. Pat. No. 3,765,178 issued to Robert Hughes Hufnagle, et al. on Oct. 16, 1973, and assigned to the same assignee as the present invention. The afterburner flameholder of the Hufnagle, et al. patent includes an inner flame ring and an outer flame ring spaced radially outwardly from and concentric to the inner flame ring to form an annular flow passage for receipt of the turbine exhaust. An inlet screen comprising a plurality of circumferentially spaced apart tubes is provided between the inner and outer flame rings closely adjacent the annular inlet thereto in order to meter the flow between the flame rings and precipitate turbulence in the wake behind the screen and thereby minimize circumferential temperature gradients in the incoming gas. Further, at the outlet to the annular flow passage, circumferentially spaced apart air foil type swirl vanes, radially extending between the inner and outer flame rings are provided in order to produce rapid propagation of flame around the entire flameholder and to provide a surface for holding the flame.

Flameholders of the type described in the Hufnagle et al. patent provide a flowpath for the hot turbine gases which is smooth and without abrupt changes or discontinuities so as to reduce the risk of "flashback" and "preignition".

Flashback can generally be described as an upstream propagation of the afterburner flamefront into the interior of the flameholder in the area between the flame rings, and may occur if the velocity of the flow through the flameholder falls off locally below the minimum velocity required to maintain flame attachment. Preignition is not as well understood as flashback, and relates to a sudden spontaneous ignition of the flow in the area between the flame rings of the flameholder. Preignition differs essentially from flashback in that the upstream preignition flame inside the flameholder exists independently of the downstream flame which remains attached to the flame ring trailing edges. preignition may be a direct result of temperature gradients in the flow through the flameholder. The deleterious effects from flashback and preignition are essentially the same, resulting in a premature localized burning of the flameholder components.

While minimizing the occurrence of flashback and preignition, afterburner flameholders of the type disclosed in the Hufnagle et al. patent have several disadvantages. One such disadvantage is that the airswirl vanes located at the outlet to the annular flow passage have demonstrated poor flameholding characteristics. Accordingly, flameholders of the type disclosed in the Hufnagle et al. patent have been subjected to flameout under various operating conditions. Another disadvantage of flameholders of the type disclosed in the Hufnagle et al. patent is that the outer edges of the swirl vanes which come in contact with the flame have not been able to sustain the high temperatures to which they have been exposed and accordingly have been subject to structural damage due to overheating.

It is therefore an object of this invention to provide an afterburner flameholder wherein the flowpath therethrough is smooth and uniform to thereby reduce the risk of flashback and preignition.

It is also an object of this invention to provide an afterburner flameholder having a relatively high internal air velocity so as to preclude flashback and preignition.

It is a further object of this invention to provide an afterburner flameholder which exhibits highly stable flameholding characteristics.

It is a further object of this invention to provide an afterburner flameholder which utilizes a system of swirl vanes to create circumferential flow to provide uniform fuel air mixture, and to establish shear turbulence behind the flameholder to enhance the burning characteristics of the afterburner.

A further object of this invention is to provide an afterburner flameholder in which the swirl vanes are out of contact with the flame so that they are not susceptible to high temperature structural damage.

A further object of this invention is to provide an annular recirculating V-gutter downstream of the swirl vanes to provide a strong recirculation zone for stable combustion of a portion of the carbureted fuel air mixture.

It is still a further object of this invention to provide an afterburner flameholder which uses a system of radially extending V-gutters to improve its flame spreading characteristics.

SUMMARY OF THE INVENTION

A gas turbine engine of the type having a compressor, combustor and turbine in serial flow relation is provided with thrust augmentation by an afterburner. The afterburner includes a flameholder having an inner ring and an outer ring spaced radially outwardly from and concentric to the inner ring. Means are further included for introducing a main flow of fuel outside the rings together with means for attaching the rings to the engine casing. According to the means of this invention, the outer ring, in cooperation with the inner ring, define an annular passageway having an annular inlet for receipt of a portion of the hot gas flow from the engine turbine, and an annular outlet. A plurality of swirl vanes are located within the annular flowpath adjacent the inlet thereof in order to impart a circumferential swirl to the fuel gas mixture flowing therethrough to thereby improve its fuel/air mixture and burning characteristics. Means are included for introducing pilot fuel in discrete jets downstream of the annular inlet and upstream of the swirl vanes. Alternatively, the pilot fuel may be introduced downstream of the swirl vanes as would be desirable for extremely high afterburner inlet temperatures. The gas fuel mixture is swirled in a circumferential direction by the swirl vanes in order to deliver a uniform fuel/air mixture to the flameholding ring and to provide for rapid propagation of the flame around the entire flameholder. The outer ring extends downstream of the inner ring. The downstream end of the outer ring diverges conically outward and terminates in a ring extension concentric with the inner ring. A circumferential annular V-gutter is attached to the downstream end of the inner ring in order to provide a flameholding surface. A ring extension is secured to the inner wall of the V-gutter and extends downstream of the V-gutter outer wall in vertical alignment with the downstream extension of the flameholder outer ring in order to provide a protective shroud around the flameholding surfaces in order to further improve the flame stability.

According to another feature of the invention, radially extending V-gutters may be secured to the downstream end of the inner ring to improve radially inward flame spreading.

DESCRIPTION OF THE DRAWINGS

While the specification concludes with claims distinctly claiming and particularly pointing out the invention described herein, it is believed that the invention will be more readily understood by reference to the discussion below and the accompanying drawings in which:

DESCRIPTION OF THE PREFERRED EMBODIMENT

Figure 1:
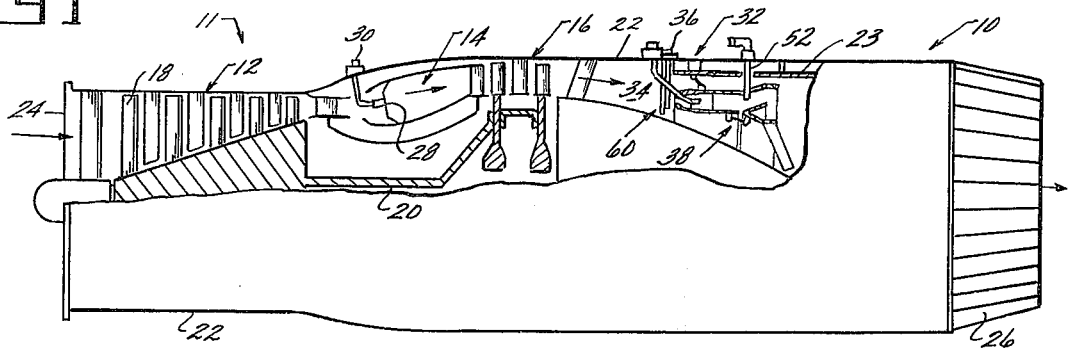
FIG. 1 is a side elevational view, partly in cross-section, of a gas turbine engine embodying the afterburner flameholder of this invention.

Referring to FIG. 1, there is shown a gas turbine engine of the turbojet type comprising a core engine 11, consisting of a compressor 12 in flow communication with a combustor 14 which generates a hot gas stream to drive a turbine 16. The turbine 16 is connected to and drives the rotor 18 of compressor 12 through a drive shaft 20. An outer casing 22 and inner liner 23 are mounted concentric with the core engine 11 to define an inlet 3. A variable area exhaust nozzle 26 is mounted on the downstream end of the outer casing 22.

In operation, the compressor 12 pressurizes an incoming air stream to provide a highly compressed air stream for supporting combustion of fuel in the combustor 14. Fuel in the combustor 14 is provided by fuel injection means 28 which receives a flow of pressurized fuel through conduit 30 from a source of pressurized fuel (not shown). The hot gas stream thus generated drives the turbine 16 and is thereafter exhausted through annular passageway 34 and out exhaust nozzle 26 in order to provide forward thrust.

Additional thrust is provided by the afterburner shown generally at 32. Additional fuel is introduced to the afterburner 32 through fuel inlet means 36 connecting to a source of pressurized fuel (not shown). Means for afterburner flame attachment are provided by flameholder 38, the details of which will be made fully obvious from the discussion below.

The hot gas stream exiting from the afterburner 32 is exhausted from exhaust nozzle 26 to provide further thrust for propulsion. Although the invention is described in relation to a turbojet engine, it will be obvious to those skilled in the art that it can be applied with equal success to other types of gas turbine engines such as a turbofan.

Figure 5:
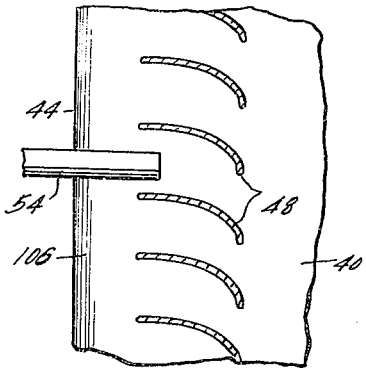
FIG. 5 is a cross-sectional view taken along the line 5—5 of FIG. 2.

Looking now to FIGS. 2 through 5, where like numerals refer to previously described elements, there is seen the flameholder 38 comprising an inner ring 40 and an outer ring 42. The inner and outer rings 40 and 42 are arranged in general concentric alignment so as to define an annular inlet 44. Outer ring 42 extends downstream of and diverges conically outward from inner ring 40. The annular trailing edge of ring 42 diverges inward from the conical portion thereof to form a ring extension in general concentric alignment with the ring 40. Separation between the rings 40 and 42 is maintained by a plurality of circumferentially spaced apart and radially extending swirl vanes 48 located downstream and adjacent inlet 44. The cross-sections of the vanes 48 are best seen in FIG. 5. The upstream ends 105 and 106 of rings 40 and 42 respectively are curved radially inward to permit only a predetermined amount of gas to flow through the annular passageway 43 therebetween.

Figure 2:
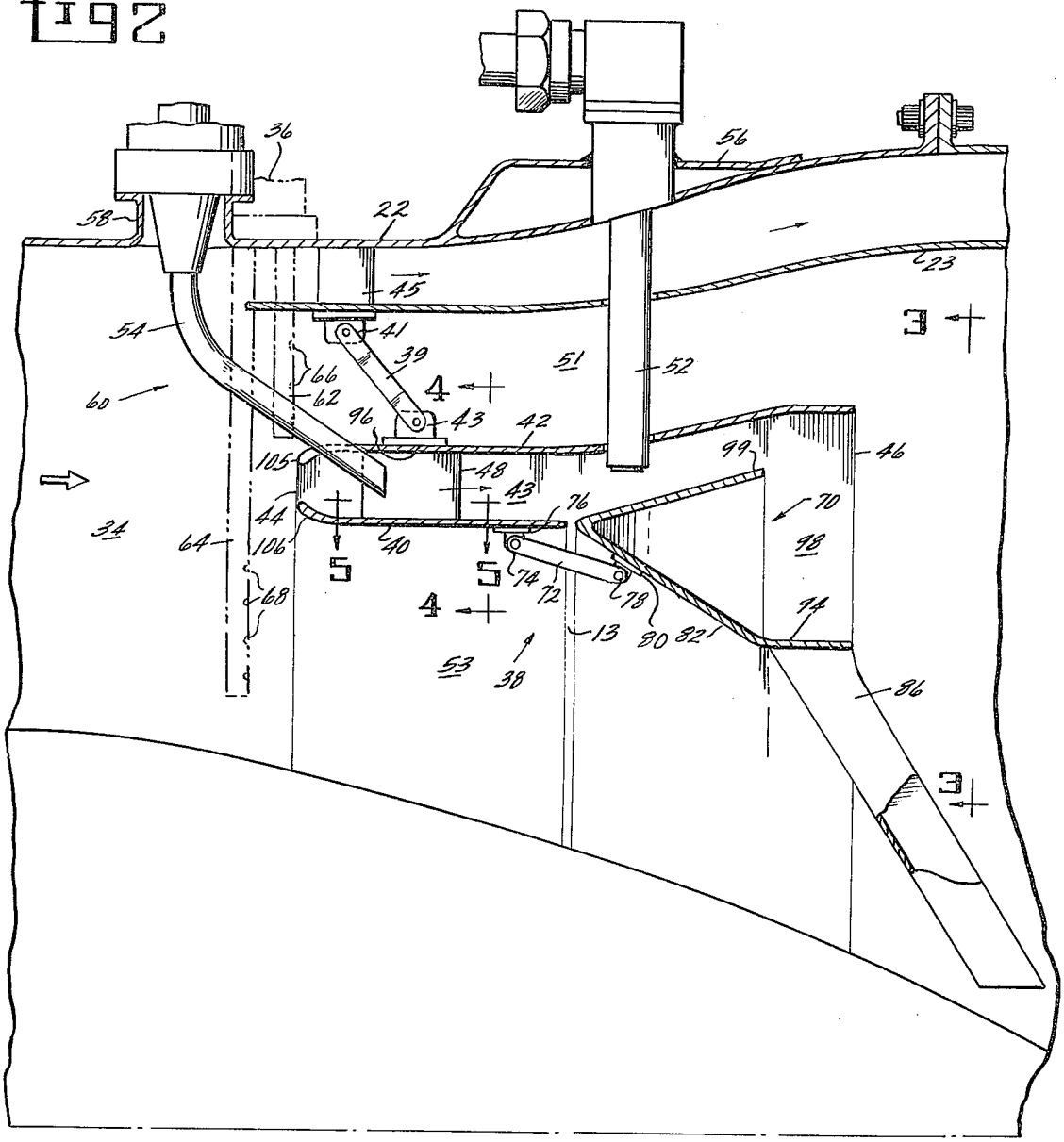
FIG. 2 is an enlarged cross-sectional view of the upper portion of the afterburner flameholder of FIG. 1.
Figure 3:
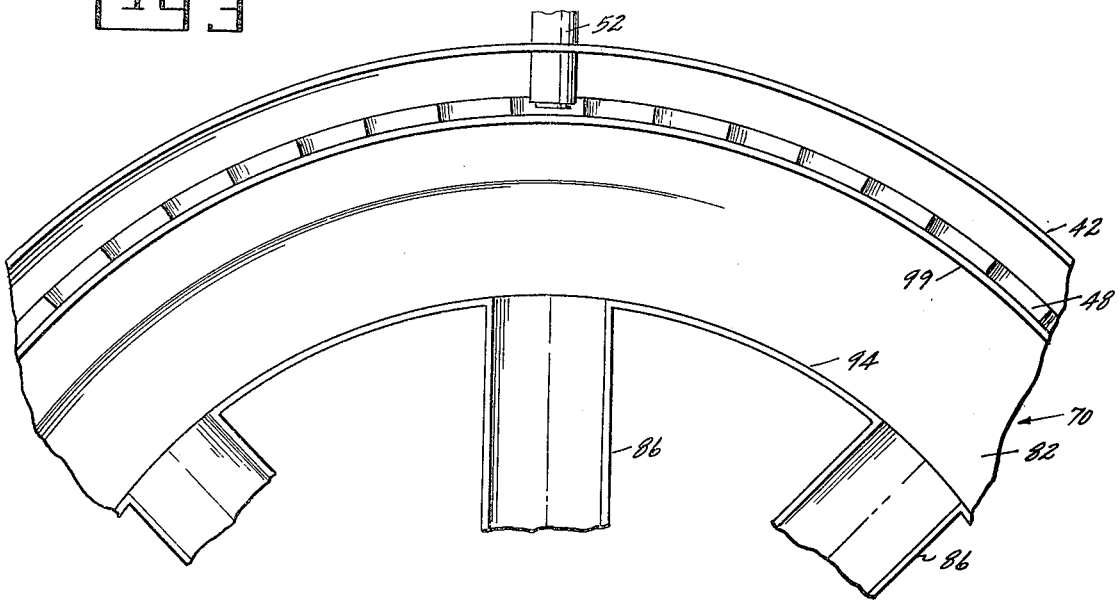
FIG. 3 is a cross-sectional view, taken along the line 3—3 of FIG. 2.
Figure 4:
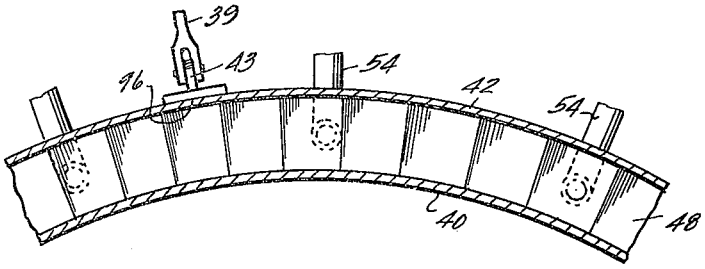
FIG. 4 is a cross-sectional view taken along the line 4—4 of FIG. 2.

The flameholder 38 may be secured to the engine outer casing 22 by any suitable means which, as illustrated in FIG. 2, is by means of a plurality of circumferentially spaced retaining links 39, each having one end pivotally attached to the outer mid portion 96 of ring 42 at a plurality of circumferentially spaced pivots 43 and the other ends pivotally attached to the inner liner 23 at a plurality of circumferentially spaced pivots 41 which are secured to the engine casing 22 by means of respective struts 45 which are in fixed connection between the inner liner 23 and the engine outer casing 22. The pivotal feature of the retaining links 39 is provided to accommodate thermal expansion of the flame ring 42 which may result in a radial outward growth of the flameholder 38.

The afterburner fuel inlet means 60 comprises a plurality of main fuel inlet conduits 62 and 64. The conduit 62 provides fuel to the annular chamber 51 surrounding ring 42, while the conduit 64 provides fuel to the inner flow chamber 53 surrounded by ring 40. Each main fuel inlet conduit 62 and 64 includes a plurality of radially spaced apertures 66 and 68 respectively, so as to discharge main jet streams of fuel into the chambers 51 and 53 respectively.

A plurality of pilot fuel conduits 54 are equally spaced around the annular inlet 44 of flameholder 38. Each pilot fuel conduit 54 disperses fuel between the leading edges of adjacent primary vanes 48. The circumferential swirl from vanes 48 acts to carburet the fuel and assure a highly uniform and vaporized fuel/air mixture at the downstream end of the flameholder 38, with a limited number of fuel injection jets 54. Each pilot fuel conduit is secured to the engine casing 22 by means of a respective flange 58.

An annular V-gutter 70 is mounted to the inner ring 40 by a plurality of circumferentially spaced apart retaining links 72. The upstream ends of retaining links 72 are rotatably pinned at pivot 74 to flange elements 76 attached to the exterior wall of ring 40. The downstream ends of retaining links 72 are rotatably pinned at pivot 78 to flange elements 80 which are in fixed connection to the exterior annular wall 82 of the lower portion of annular V-gutter 70. V-gutter 70 is retained adjacent to but separate from ring 40 by retaining links 72 in order to permit thermal expansion between the rings 40 and V-gutter 70 since, in operation, the temperature of V-gutter 70 is significantly greater than the temperature of the ring 40. The axial gap 13 between ring 40 and annular V-gutter 70 permits a small portion of the fuel-air mixture to propagate along the radially inward extending wall 82 of V-gutter 70 in order to reduce the pilot fuel flow required to ignite the afterburner during extreme low pressure, high altitude conditions. In order to improve the ducting of the fuel air mixture along the inner wall 82 of V-gutter 70, the downstream end of annular ring 40 may be curved radially inward and elongated to extend parallel to but spaced apart from the inner wall 82 of V-gutter 70 to a point in proximate vertical alignment with the mid span of inner wall 82.

The radially inward extending wall 82 of annular V-gutter 70 includes a downstream ring extension 94 concentric to and vertically aligned with the downstream extension 46 of the ring 42 to form an annular flowpath extension 98. The radially outward extending wall 99 of V-gutter 70 is recessed within the annular flow passage extension 98. Ring members 42 and 94 form an annular flow passage 98 aft of the V-gutter 70 so as to increase the stability of the flame therein.

In accordance with an optional feature of the invention, a plurality of circumferentially spaced radially extending auxiliary V-gutters 86 may be attached to the downstream extension 94 of the inner wall 82 of V-gutter 70.

A spark igniter 52 extends through the ring 42 and terminates within the passageway 43 in order to provide a point source spark to ignite the fuel/air mixture within the annular flow passage 43 between the rings 42 and 40. Spark igniter 52 is secured to the engine outer casing 22 by suitable bracket means 56. While the spark igniter is preferably located outside the flameholding V-gutter 70 in order to minimize thermal damage thereto, it is also possible to locate the spark igniter within the V-gutter 70 by extending it through the wall member 99 of V-gutter 70.

Describing now the operation of the foregoing structure for cases where additional thrust is required, the afterburner may be lit by first introducing pilot fuel through conduit 54, whereupon the pilot fuel is sparked to ignite by igniter 52. Incoming hot gas from the turbine 16 of the gas turbine engine enters the flameholder 38 by way of inlet 44. As indicated, the leading edges 105 and 106 of annular rings 42 and 40 respectively are tapered inward to provide a predefined cross-sectional area for inlet 44. This opening is sufficient to meter a predetermined portion of the total gas flow from the turbine 16 through the annular inlet 44 so as to achieve the desired stoichiometric ratio of pilot fuel to air. As previously discussed, the incoming fuel/air mixture is swirled by the swirl vanes 48 so as to thoroughly mix and vaporize the pilot fuel in the incoming gas and provide a uniform fuel/air mixture around the entire flameholder which is ignited from the initial point of ignition by spark igniter 52. The main fuel in afterburner 32 is introduced concurrently or sequentially and ignited by the pilot flame held in the main V-gutter 70 and the radially extending auxiliary V-gutters 86.

Because of the highly stable flameholding characteristics of the V-gutters 70 and 86 of flameholder 38, a higher velocity internal gas flow may be utilized in the annular flow passage 43 between the rings 40 and 42 without preignition and flashback occurring, than can be tolerated in conventional afterburner flameholders such as that described in the Hufnagle et al. patent.

As indicated, the swirl vanes of the flameholder 38 are located in the upstream end of the annular flow passage 43 formed between the rings 40 and 42 away from the flame front so as to avoid excessive damage thereto from overheating. The flameholder gutter 70 may be readily separated from the balance of the flameholder assembly to improve the maintainability and simplify replacement thereof.

Various changes could be made in the structures shown in FIGS. 1 through 5 without departing from the scope of the invention. As indicated, it may be desirable to locate the fuel inlet conduit 54 downstream of the swirl vanes 48; alternatively, as indicated, it may also be desirable to locate the igniter 52 within the V-gutter 70.

Therefore, having described preferred embodiments of the invention, though not exhaustive of all possible equivalents, what is desired to be secured by Letters Patent of the United States is claimed below.

What is claimed is:

1. A flameholder for the afterburner of a gas turbine engine comprising:

an inner ring, an outer ring spaced radially outward from and concentric to the inner ring to form an annular flow passage therebetween for receipt of the hot gases exhausted from the engine turbine, means for introducing pilot fuel into the flow passage to mix with the hot gases therein, means within the flow passage for imparting a circumferential swirl to the fuel gas mixture flowing therethrough, means for igniting the swirled fuel gas mixture to generate a pilot flame, and annular V-gutter means secured to the downstream end of the inner ring for providing a surface to which the pilot flame may attach.

2. The flameholder of claim 1 further comprising radially extending V-gutter means in vertical alignment with the annular V-gutter means for spreading the pilot flame radially within the afterburner.

3. The flameholder of claim 1 wherein:

the outer ring extends downstream of and diverges conically outward from the inner ring and terminates in an annular ring extension in concentric alignment with the inner ring to form the outer wall of the outlet for the annular flow passage, and the annular V-gutter means includes a downstream ring extension concentric to and vertically aligned with the annular ring extension of the outer ring to provide the inner wall of the outlet for the annular flow passage and together with the outer ring extension forms a protective shroud around the flameholding surfaces of the annular V-gutter means to thereby improve flame stability.

4. The flameholder of claim 1 further including retaining link means connected between the inner ring and the annular V-gutter means for holding the annular V-gutter means apart from and in concentric alignment with the trailing edge of the inner ring so as to permit relative growth due to thermal expansion between the inner ring and the annular V-gutter means.

5. The flameholder of claim 1 wherein the igniting means comprises a spark igniter within the annular flow passage downstream of the swirl means and the points at which pilot fuel is introduced.

6. The flameholder of claim 1 wherein the igniting means comprises a spark igniter within V-gutter of the annular V-gutter means.

7. The flameholder of claim 1 wherein the swirl means comprises a plurality of swirl vanes circumferentially spaced around the interior of the flow passage and the pilot fuel is introduced into the flow passage at points between the swirl vanes.

8. The flameholder of claim 1 wherein the pilot fuel is introduced into the flow passage downstream of the swirl means.

9. The flameholder of claim 1 wherein the upstream end of the outer ring converges radially inward and the upstream end of the inner ring diverges radially outward to thereby provide a restricted inlet to the flow passage so that only a predetermined portion of the turbine exhaust is permitted to enter the flow passage to thereby control the internal velocity and stoichiometry of the fuel gas mixture.

10. A flameholder for the afterburner of a gas turbine engine comprising:

an inner ring having a radially outward diverging upstream end, an outer ring spaced radially outward from and concentric to the inner ring and having a radially inward converging upstream end to form an annular passage between the inner and outer rings having a restricted inlet for receipt of the hot gases exhausted from the engine turbine and having a downstream end which extends downstream of and converges conically outward from the trailing edge of the inner ring and terminates in an annular ring extension in concentric alignment with the inner ring, a plurality of swirl vanes circumferentially spaced around the interior of the annular passage between the inner and outer rings to impart a circumferential swirl to the gases impinging thereon, a plurality of pilot fuel jets in flow communication with the annular passage at respective points between different pairs of swirl vanes to deliver pilot fuel to the annular passage, an annular V-gutter having generally radially outward and radially inward extending walls held in concentric alignment with the downstream end of the inner ring by a plurality of retaining links and having an annular ring extension of the radially inward extending wall, said ring extension being concentric to and vertically aligned with the annular ring extension of the outer ring and together with the outer ring extension form the outlet of the flow passage and provide a protective shroud around the flameholding surfaces of the annular gutter, and a spark igniter within the annular passage downstream of the swirl vanes to ignite the fuel gas mixture therein.

11. The flameholder of claim 10 further comprising a plurality of circumferentially spaced and radially extending V-gutters secured to the ring extension of the radially inwardly extending leg of the annular V-gutter.

* * * * *